US005788940A

United States Patent [19]

Cicha et al.

[11] Patent Number: 5,788,940

[45] Date of Patent: Aug. 4, 1998

[54] METHOD AND APPARATUS FOR STERILIZING CARTONS THROUGH ULTRAVIOLET IRRADIATION

[75] Inventors: John Cicha, Shoreview; Terry Erickson; Walt Monpetit, both of St. Paul, all of Minn.

[73] Assignee: Tetra Laval Holdings & Finance SA, Pully, Switzerland

[21] Appl. No.: 735,877

[22] Filed: Oct. 23, 1996

[51] Int. Cl.[6] ..... A61L 2/10; B65B 55/02; B65B 55/04

[52] U.S. Cl. ..... 422/24; 53/425; 53/426; 99/451; 250/504 R; 250/455.11

[58] Field of Search ..... 422/186.3, 24, 422/121; 53/425, 426; 99/451; 250/504 R, 494.1, 455.11, 433, 453.11

[56] References Cited

U.S. PATENT DOCUMENTS

| | | | |
|---|---|---|---|
| 3,984,726 | 10/1976 | Ramler | 315/107 |
| 3,986,018 | 10/1976 | Ishii | 362/218 |
| 4,375,145 | 3/1983 | Mosse et al. | 53/425 |
| 4,494,357 | 1/1985 | DiGeronimo | 53/167 |
| 5,129,212 | 7/1992 | Duffey et al. | 116/30 |
| 5,326,542 | 7/1994 | Sizer et al. | 422/291 |
| 5,433,920 | 7/1995 | Sizer et al. | 422/24 |
| 5,445,793 | 8/1995 | Tuckner et al. | 422/28 |
| 5,494,691 | 2/1996 | Sizer | 426/392 |
| 5,606,169 | 2/1997 | Hiller et al. | 250/455.11 |

OTHER PUBLICATIONS

Aquionics Inc.,–Surface Sterilization with Advanced UV Disinfection Systems, Mar. 1991.

*Primary Examiner*—Robert J. Warden
*Assistant Examiner*—Alex Noguerda
*Attorney, Agent, or Firm*—Michael A. Catania

[57] ABSTRACT

The present invention utilizes a plurality of ultraviolet lamps to sterilize containers being advanced along a conveyor system. The ultraviolet lamps are disposed transverse to the advancement of the containers as are the reflectors corresponding to each of the lamps. The reflectors are in direct contact with a cooling manifold which prevents the overheating of the apparatus. In thermal contact with the cooling manifold are temperature detectors which provide warning signals to operators, or can generate a signal to deactivate the lamps. The cooling manifold may be cooled by a circulating fluid. The reflectors may be cooled by a flow of air through a pressurized chamber. The pressurized chamber is defined by the reflectors and transparent plates. The transparent plates substantially enhance the transmission of light having a wavelength of 254 nanometers.

12 Claims, 8 Drawing Sheets

METHOD AND APPARATUS FOR STERILIZING CARTONS THROUGH ULTRAVIOLET IRRADIATION

TECHNICAL FIELD

The present invention relates to a method and apparatus for sterilizing cartons. Specifically, the present invention relates to a method and apparatus for sterilizing cartons through ultraviolet irradiation.

BACKGROUND

The aseptic packaging of food products has grown enormously in the past few years which has resulted in greater demands for aseptic packaging processes in the areas of efficiency and applicability. The ability of a food product to be stored at room temperature for an extended period of time (greater shelf-life) is the main reason for the growth of aseptic packaging. The elimination of bacteria which leads to spoilage of the food product allows for this greater shelf life for aseptically packaged food products. The elimination of the bacteria is accomplished through sterilization of the container for the food product just prior to the filling of the container with a food product.

Ultraviolet radiation has proven to be an effective means to sterilize packaging for food products. Numerous inventions have been disclosed which utilize ultraviolet radiation to sterilize food packaging. For example, Peel et al, U.S. Pat. No. 4,289,728, for Improvements In Methods Of Sterilization discloses the effects of hydrogen peroxide and ultraviolet radiation on numerous organisms. Peel et al sets forth the use of an irradiated solution to sterilize food packaging.

Integration within a forming, filling and sealing machine is an important function for sterilization through ultraviolet radiation. For example, Sizer et al, U.S. Pat. No. 5,326,542, for a Method And Apparatus For Sterilizing Cartons, discloses a method and apparatus which utilizes ultraviolet radiation to sterilize food cartons which are advanced along a conveyor system on a filling machine. Another example is Mosse et al, U.S. Pat. No. 4,375,145, for a Packaging, Particularly Aseptic Packaging Of Aseptic Products In Cartons which discloses a method for sterilizing cartons by the utilization of ultraviolet lamps and hydrogen peroxide as the cartons are conveyed along a filling machine.

The foregoing patents, although efficacious in the sterilization of food packaging, are not the denouement of the problems of sterilizing cartons. There are still unresolved problems which compel the enlargement of inventions in the sterilization of food packaging.

SUMMARY OF THE INVENTION

One embodiment of the present invention is an apparatus for sterilizing cartons which are being advanced along a conveyor system. The apparatus comprises a plurality of sources of ultraviolet light, a plurality of reflectors, a cooling system and a shutter assembly. Each of the plurality of sources of ultraviolet light are elongated and have a longitudinal axis which is substantially transverse to the advancement of the cartons along the conveyor system. Each of the plurality of reflectors extend along the longitudinal axis of each of the corresponding plurality of ultraviolet light sources. Each of the plurality of reflectors are disposed a predetermined distance from each of the corresponding plurality of ultraviolet light sources. Each of the plurality of reflectors substantially reflects an incident ultraviolet radiation toward the interior of the cartons. The cooling system is generally disposed above the plurality of reflectors and in thermal communication with each of the plurality of reflectors. The shutter assembly selectively blocks the ultraviolet radiation emitted from the plurality of ultraviolet light sources.

The apparatus may further comprise a plurality of transparent plates. Each of the plurality of transparent plates correspond to each of the plurality of ultraviolet light sources and form an enclosed pressurized environment about each of the plurality of ultraviolet light sources. The apparatus may further comprise a plurality of pressure switches to detect and indicate a decrease in pressure in the enclosed pressurized environment. The apparatus may further comprise a plurality of temperature switches for indicating an elevated temperature at a corresponding plurality of ultraviolet light sources. Each of the plurality of temperature switches has a means for deactivating each corresponding plurality of ultraviolet light sources when an elevated temperature is detected.

The cooling system may comprise a cooling manifold substantially encompassing and in thermal communication with the upper surface of each of the plurality of reflectors. The cooling manifold has a plurality of passageways for the flow of a circulating fluid. The circulating fluid most likely will be water, however other fluids are contemplated in the present invention. The cooling system may further comprise means for introducing a gas between each of the plurality of reflectors and each of the plurality of ultraviolet light sources which has the effect of cooling the reflectors and the plurality of ultraviolet light sources.

Each of the plurality of reflectors may be transversely curved about the longitudinal axis, and each of the plurality of reflectors may have opposite parabolic sides connected to each other along an apex parallel to the longitudinal axis. Each of the plurality of reflectors may also be rotated from the vertical about 13 degrees toward each other, and may also have a common focus at the each of the corresponding ultraviolet light sources. Each of the transparent plates substantially enhances the transmission of light having a wavelength of 254 nanometers. The pressurization of the apparatus also allows for detection of the transparent plates if they should crack or break.

Another embodiment of the present invention is a method for sterilizing cartons which are being advanced along a conveyor system. The method generally comprises four steps. The first step is to position each of the cartons within a sterilization apparatus located on the conveyor system. The next step is to subject each of the cartons to a predetermined amount of ultraviolet radiation for a predetermined time sufficient to sterilize each of the cartons. The ultraviolet radiation originates from the sterilization apparatus. The next step is to substantially maintain a predetermined temperature for the sterilization apparatus while simultaneously optimizing the predetermined amount of ultraviolet radiation originating from the sterilization apparatus. The final step is to remove each of the cartons from within the sterilization apparatus.

The apparatus comprises a plurality of sources of ultraviolet light, a plurality of reflectors, a cooling system and a shutter assembly. Each of the plurality of sources of ultraviolet light are elongated and have a longitudinal axis which is substantially transverse to the advancement of the cartons along the conveyor system. Each of the plurality of reflectors extend along the longitudinal axis of each of the corresponding plurality of ultraviolet light sources. Each of the plurality of reflectors are disposed a predetermined distance from each of the corresponding plurality of ultraviolet light sources. Each of the plurality of reflectors substantially reflects an incident ultraviolet radiation toward the interior of the cartons. The cooling system is generally disposed above the plurality of reflectors and in thermal communication with each of the plurality of reflectors. The shutter assembly selectively blocks the ultraviolet radiation emitted from the plurality of ultraviolet light sources and also allows for a safety factor in that harmful ultraviolet radiation is not a hazard to individuals working near the apparatus. The shutter assembly is also water cooled so that when it is in its closed position it will absorb the heat generated by the ultraviolet light source. When the shutter assembly is opened, the ultraviolet radiation is directed toward the container to prevent harmful ultraviolet radiation from radiating outside of the apparatus in a horizontal direction.

The step of subjecting the cartons to a predetermined amount of ultraviolet radiation is accomplished through direct radiation from the plurality of ultraviolet light sources and incident radiation from the plurality of reflectors. The sterilization apparatus may further comprise a plurality of transparent plates. Each of the plurality of transparent plates corresponds to each of the plurality of ultraviolet light sources and forms an enclosed pressurized environment about each of the plurality of ultraviolet light sources. The sterilization apparatus may further comprise a plurality of pressure switches to detect and indicate a decrease in pressure in the enclosed pressurized environment. The sterilization apparatus may further comprise a plurality of temperature switches for indicating an elevated temperature at a corresponding plurality of ultraviolet light sources. Each of the plurality of temperature switches having means for deactivating each corresponding plurality of ultraviolet light sources when an elevated temperature is detected. The cooling system may comprise a cooling manifold substantially encompassing and in thermal communication with the upper surface of each of the plurality of reflectors. The cooling manifold may have a plurality of passageways for the flow of a circulating fluid. The cooling system may further comprise means for introducing a gas between each of the plurality of reflectors and each of the plurality of ultraviolet light sources. Each of the plurality of reflectors may be transversely curved about the longitudinal axis, and each of the plurality of reflectors may have opposite parabolic sides connected to each other along an apex parallel to the longitudinal axis. Each of the plurality of transparent plates may substantially enhance the transmission of light having a wavelength of 254 nanometers.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE DRAWINGS

Several features of the present invention are further described in connection with the accompanying drawings in which:

There is illustrated in FIG. 1 a cut-away side perspective of a preferred embodiment of the present invention.

Figure 1:
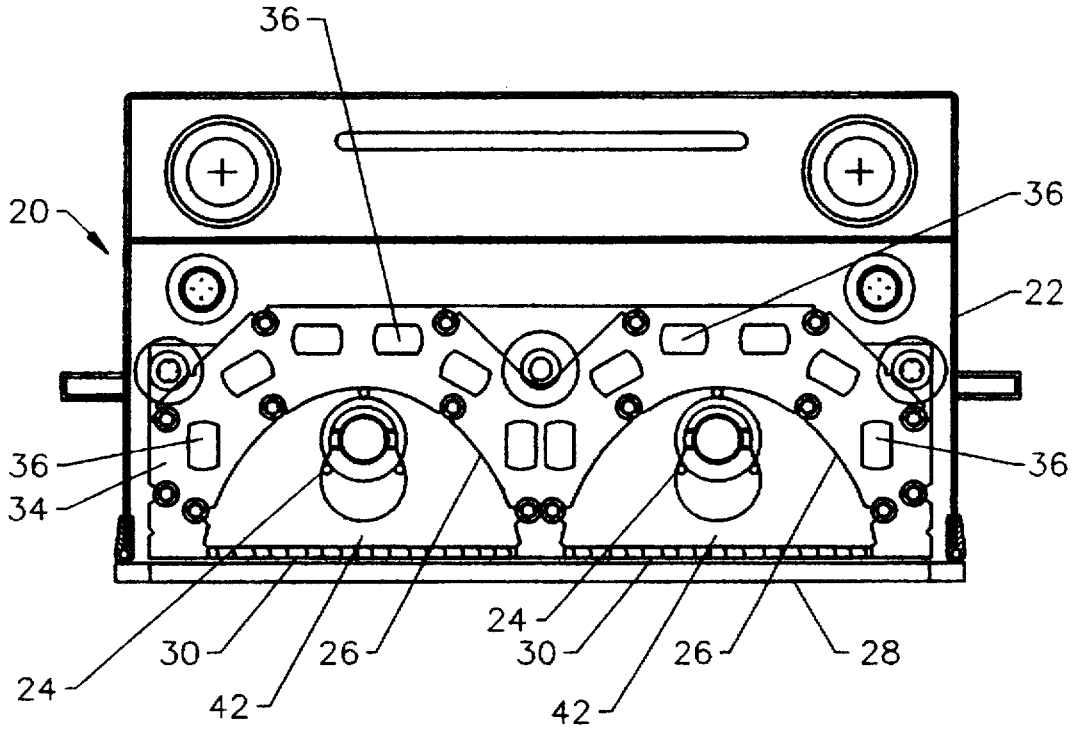
Figure 2:
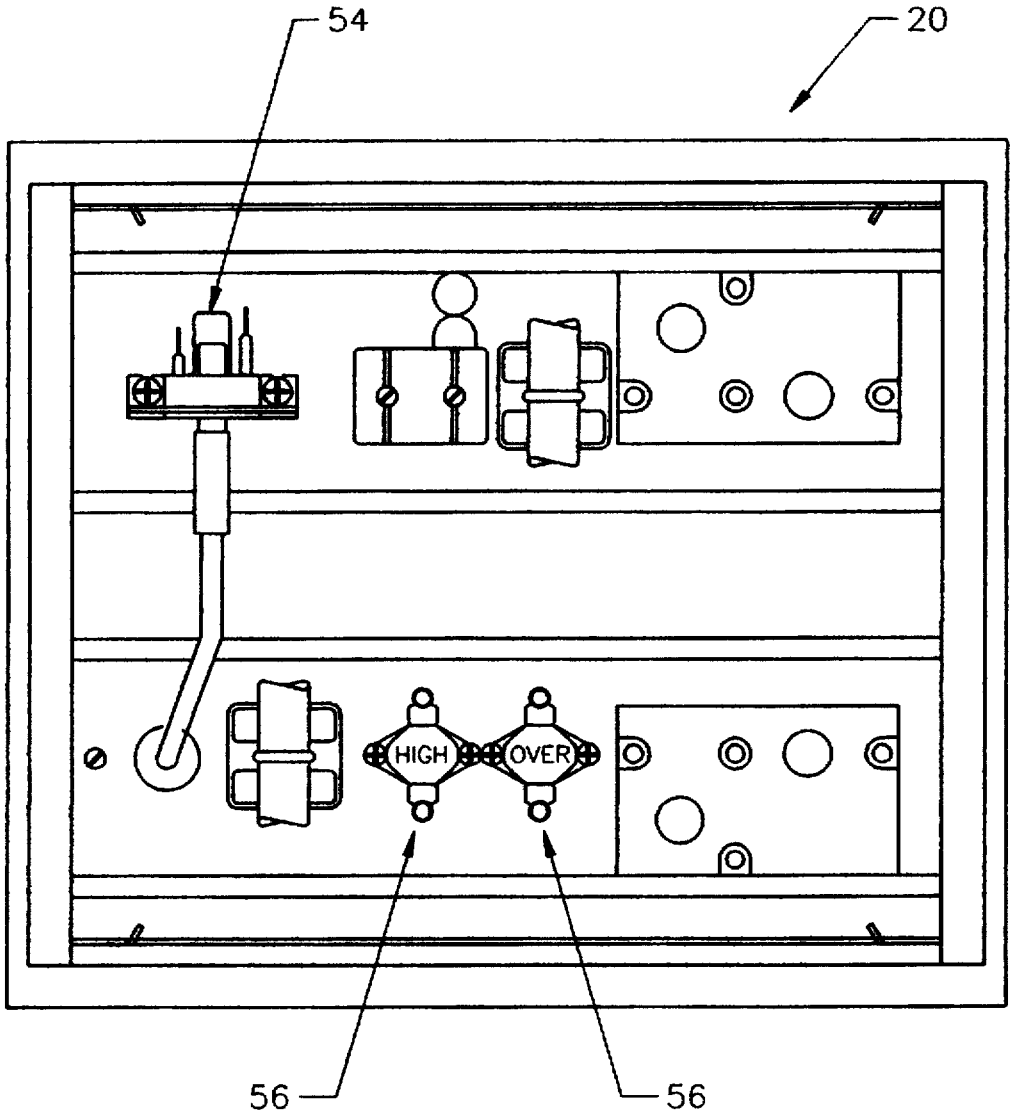

There is illustrated in FIG. 2 a top cut-away perspective of the embodiment of the present invention shown in FIG. 1.

There is illustrated in FIG. 3 an alternative embodiment of the present invention.

Figure 4:
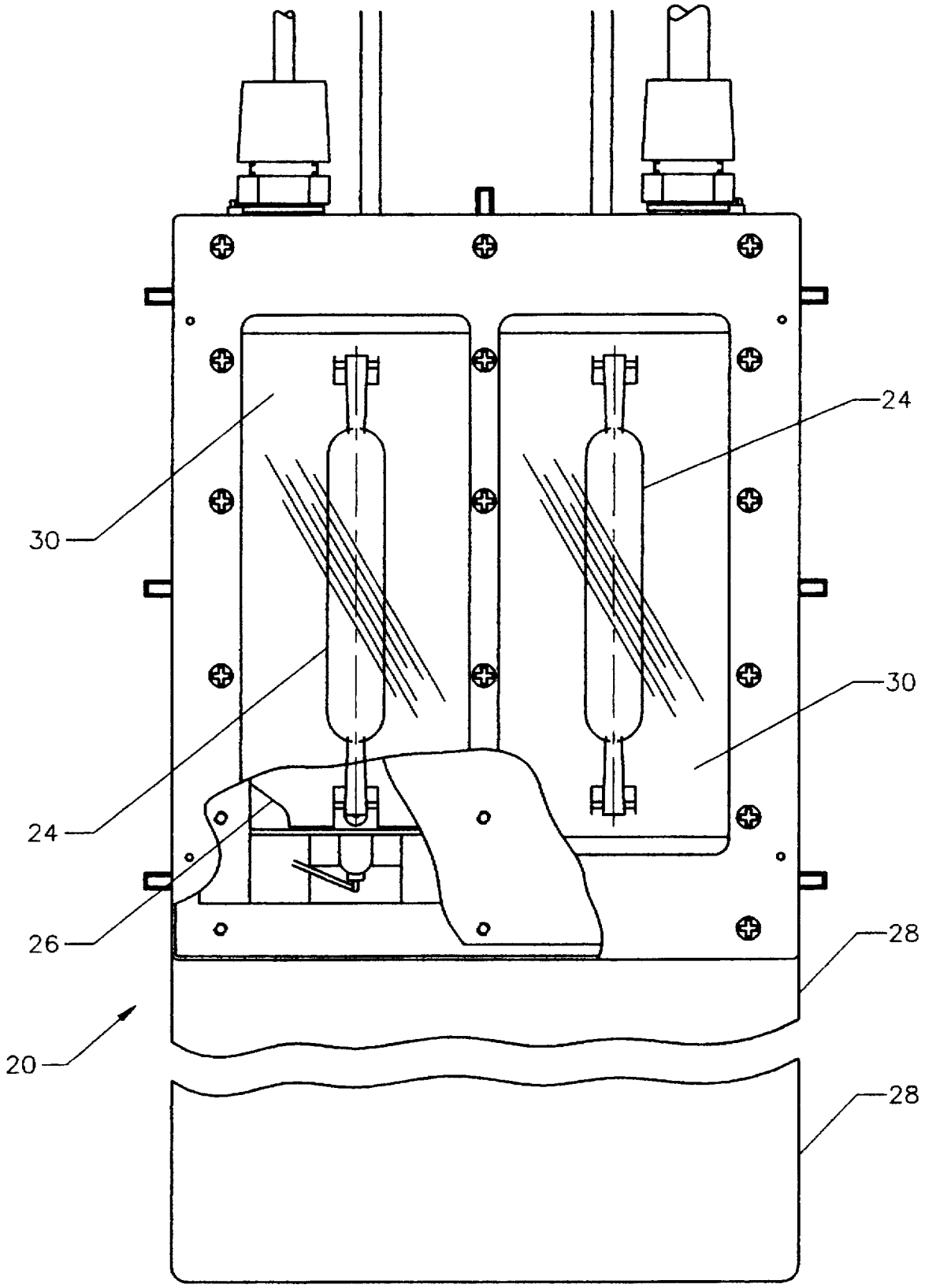

There is illustrated in FIG. 4 a bottom view of the sterilization apparatus of the present invention.

Figure 5:
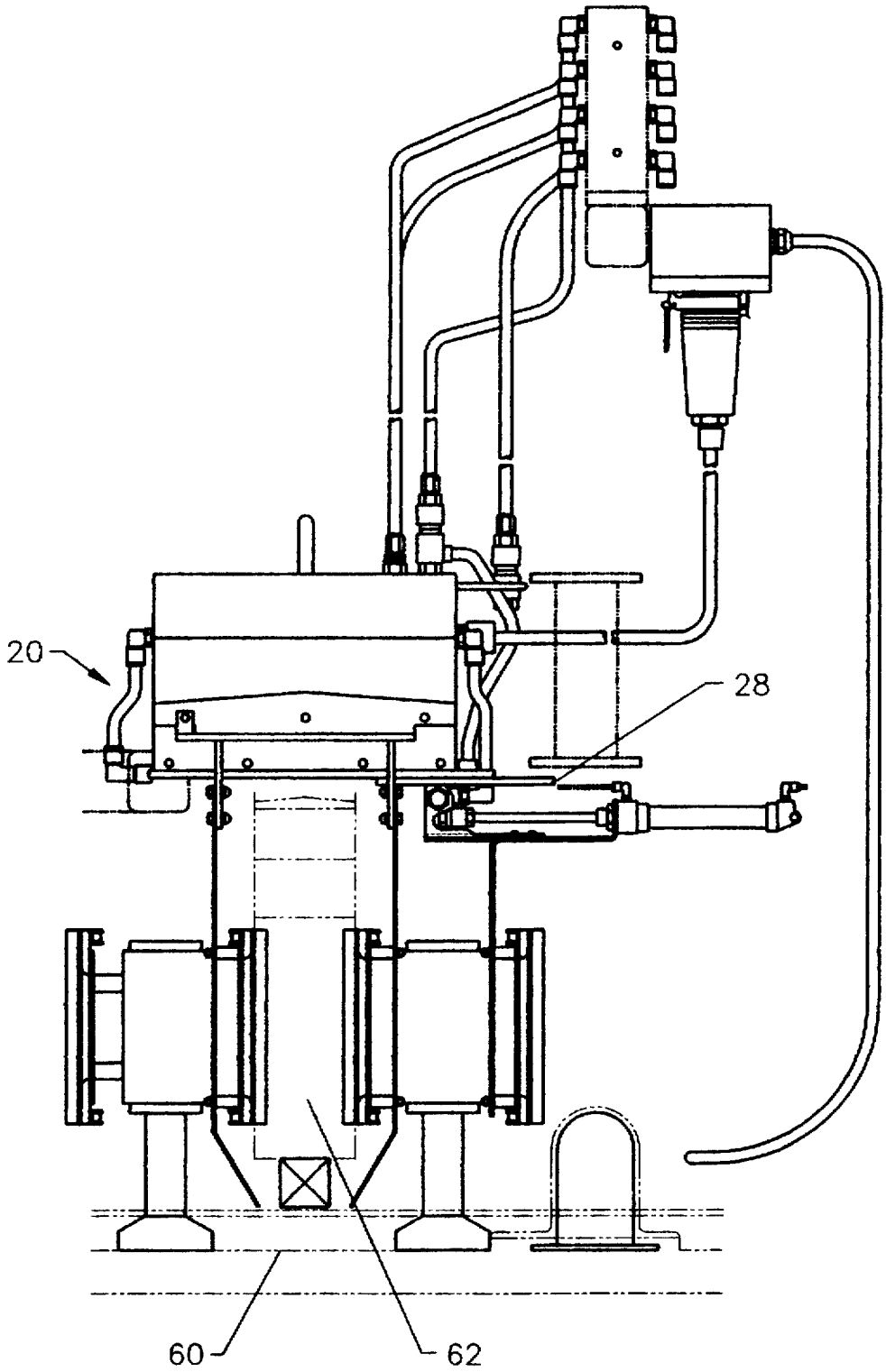

There is illustrated in FIG. 5 a rearward view of the present invention integrated above a conveyance system for advancing cartons to the sterilization apparatus.

Figure 6:
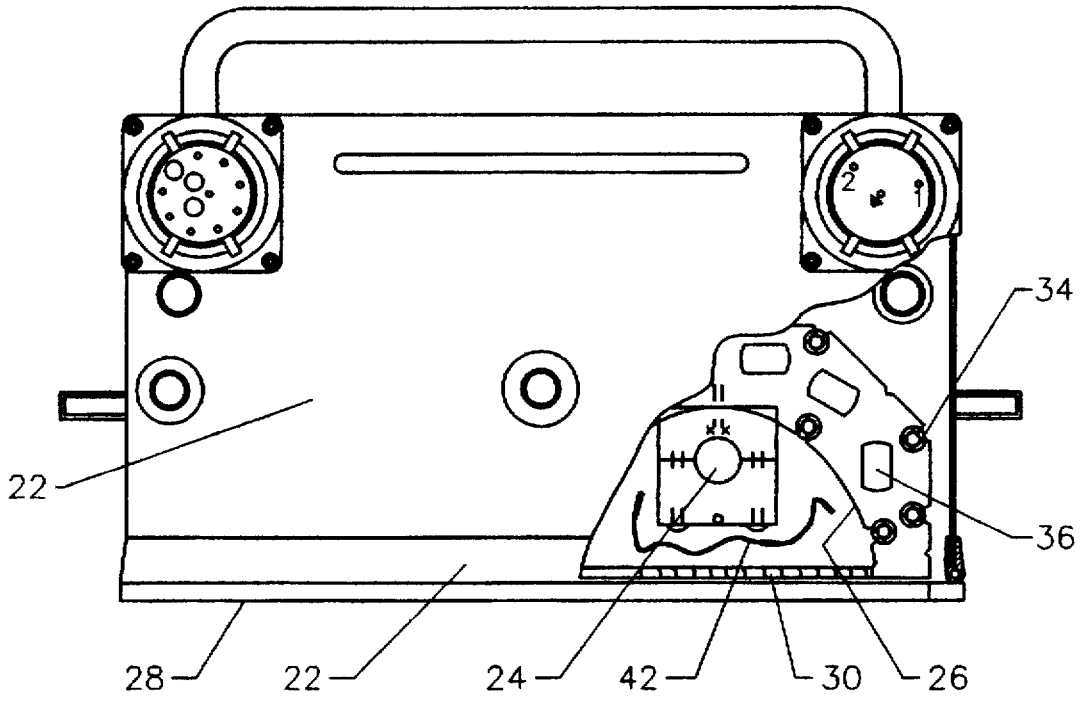

There is illustrated in FIG. 6 a side cut-away view of the sterilization apparatus of the present invention.

Figure 7:
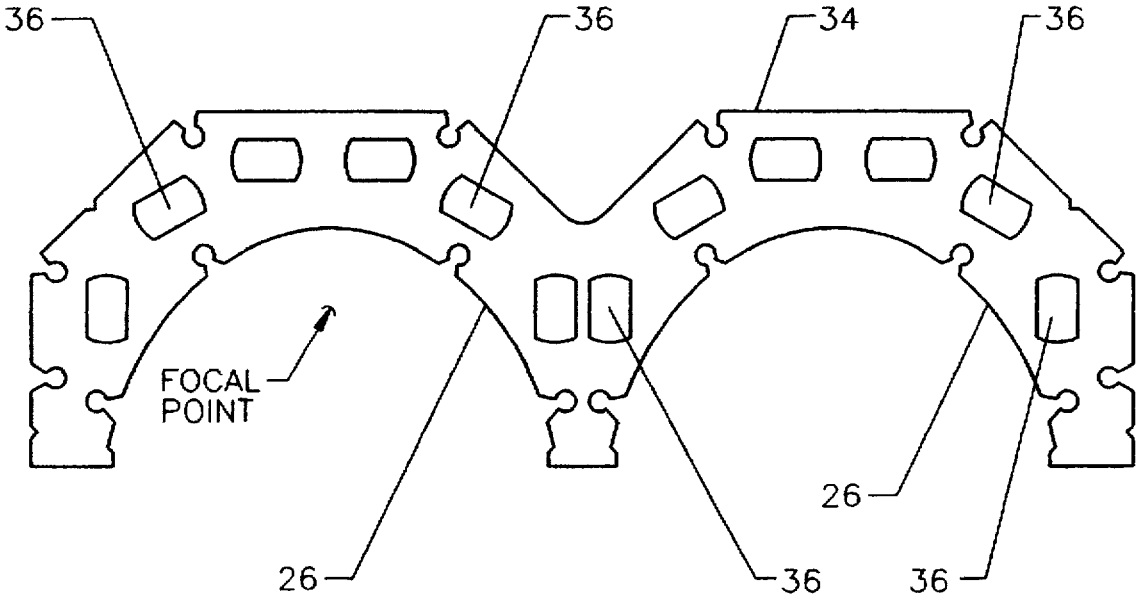

There is illustrated in FIG. 7 one embodiment of the reflectors of the present invention.

DETAILED DESCRIPTION OF THE PREFERRED EMBODIMENTS

The relationship of each of the plurality of reflectors and their corresponding ultraviolet lamps comprise an important aspect of the sterilization apparatus. The shape of the reflectors is very important for dispersing the ultraviolet radiation throughout the interior of each of the cartons undergoing sterilization. This relationship between the reflectors and ultraviolet lamps has been disclosed in Sizer et al, U.S. Pat. No. 5,326,542, and Sizer et al, U.S. Pat. No. 5,433,920 which are hereby incorporated by reference.

There is illustrated in FIG. 1 a cut-away side perspective of a preferred embodiment of the present invention. As shown in FIG. 1, a sterilization apparatus is generally designated 20. The sterilization apparatus is generally composed of a housing 22 a plurality of ultraviolet lamps 24, a plurality of reflectors 26, a shutter assembly 28, a plurality of transparent plates 30 and a cooling system generally designated 32. The cooling system 32 includes a cooling manifold 34, a plurality of fluid passageways 36, a fluid inlet 38, not shown, and a fluid outlet 40, not shown. Each of the plurality of reflectors 26 and the corresponding transparent plate 30 form an enclosed pressurized chamber 42 encompassing each of the plurality of ultraviolet lamps 24. The chamber 42 is maintained at a pressure of approximately 1.1 atmospheres. The pressurized chamber 42 enhances the effectiveness of the ultraviolet lamps 24 in sterilizing the cartons.

There is illustrated in FIG. 2 a top cut-away perspective of the embodiment of the present invention shown in FIG. 1. As shown in FIG. 2, the sterilization apparatus 20 is equipped with a pressure detector 54 for detection of a pressure drop in the chamber 42. A controlled amount of air flow is maintained through the chamber 42 by a regulator and an exit air orifice. This flow of air results in an absolute pressure of approximately 1.1 atmospheres which holds the contacts of the pressure detector 54 closed. Once a pressure drop in the chamber 42 is detected, the pressure detector produces a signal to alert an operator of the pressure drop in the chamber 42. The signal may be an audible or visual alarm. The sterilization apparatus 20 also has temperature detectors 56 for monitoring the temperature of the cooling manifold 34. If the temperature rises above a predetermined temperature, the temperature detectors 56 generate a signal to alert an operator of the temperature increase in the cooling manifold 34. A warning temperature for this embodiment is approximately 49° C. If the temperature rises above a second, higher predetermined temperature, the temperature detectors 56 generate a signal to deactivate the ultraviolet lamps 24. A deactivation temperature for this embodiment is approximately 77° C. In this manner, damage to the sterilization apparatus may be avoided even if an operator is not present to receive the first signal generated from the temperature detector. The temperature detectors 56 are mounted in direct contact with the cooling manifold 34 to provide minimum response time to an overheating of the cooling manifold 34.

The cooling system 32 of the present invention allows the sterilization apparatus to operate at a much lower temperature than previous sterilization apparatus utilizing ultraviolet radiation. The lower operating temperature is possible because of the greater cooling ability of the cooling manifold 34 in extracting heat from the reflectors 26. The fluid passageways 36 traverse a large portion of the cooling manifold 34 and thus allow for greater contact between the cooling manifold 34 and a circulating fluid such as water. The cooling system 32 is cooled by approximately 1.5 liters per minute of water. The lower operating temperature decreases the likelihood of heat damage to and also extends the life of the sterilization apparatus 20. The lower operating temperature also provides that the apparatus 20 is sufficiently cool to be touched by an operator of the machinery.

Figure 3A:
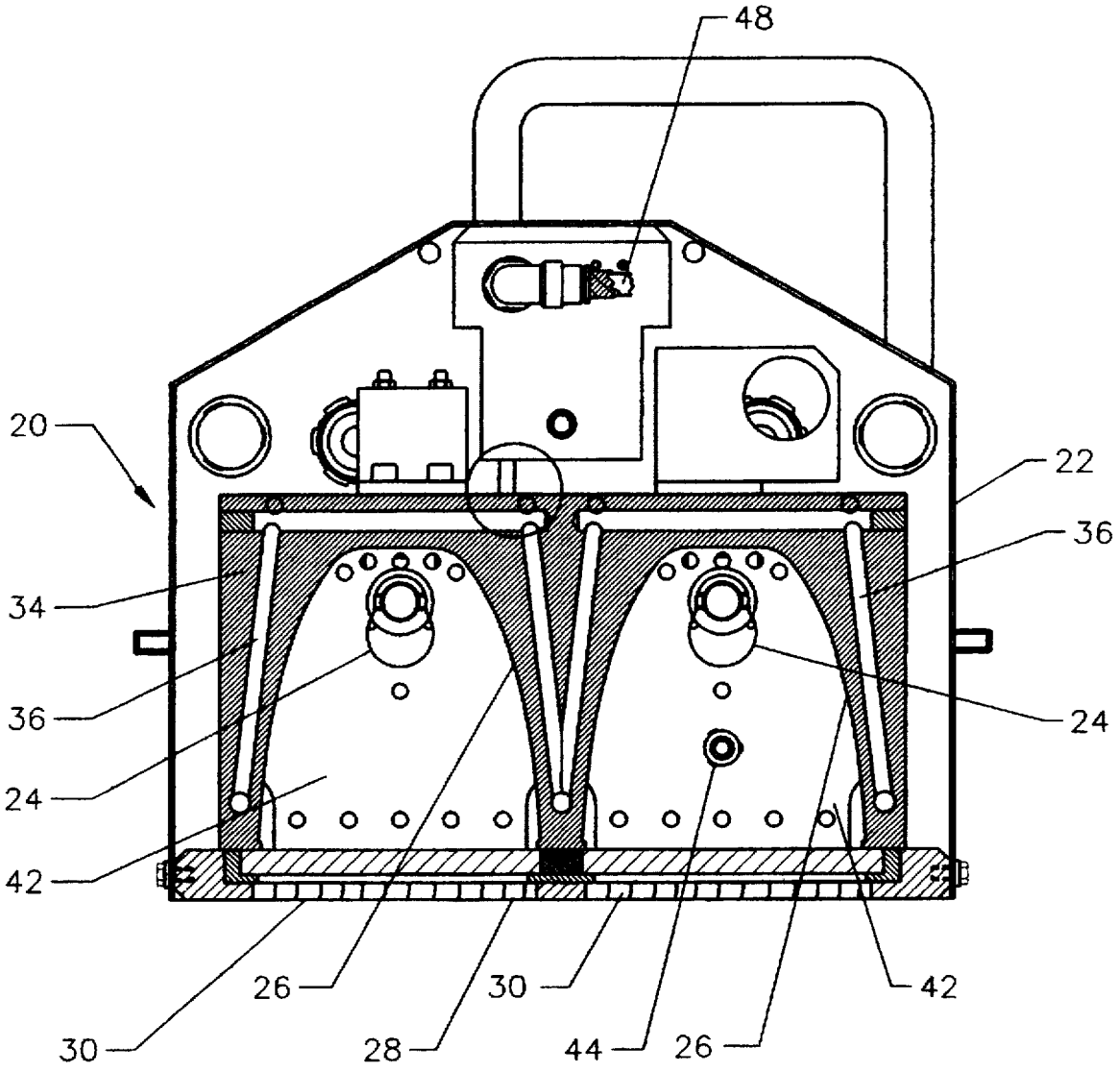
Figure 3B:
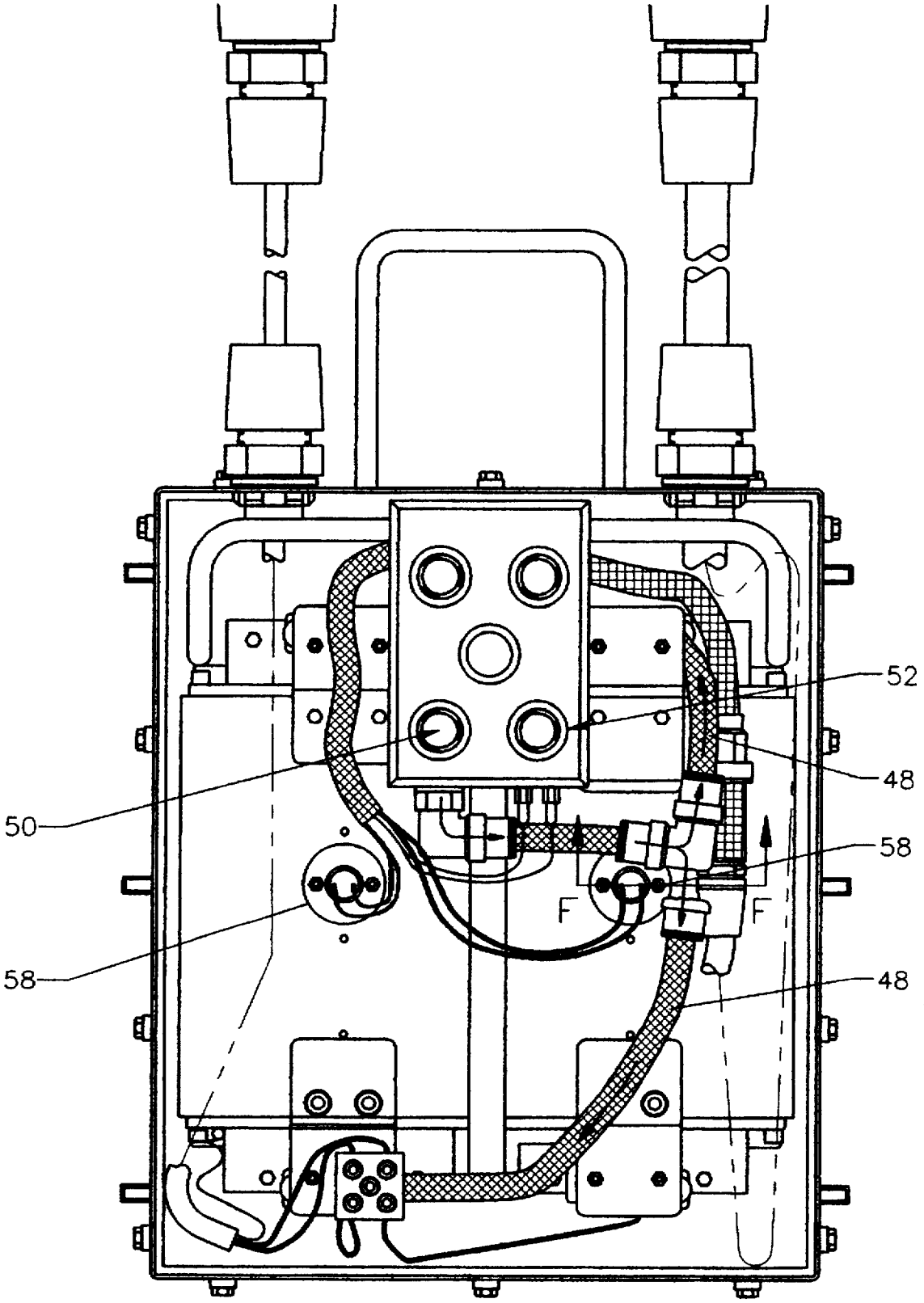

There is illustrated in FIG. 3A a cut-away side perspective of an alternative embodiment of the present invention. There is illustrated in FIG. 3B a cut-away top perspective of an alternative embodiment of the present invention. As shown in FIGS. 3A and 3B, the sterilization apparatus 20 is fairly similar to the embodiment in FIG. 1.

However, the cooling system 32 of the sterilization apparatus 20 of FIGS. 3A and 3B has a gas cooling feature to supplement the fluid cooling through the cooling manifold 34. Gas enters the enclosed pressurized chamber 42 through a chamber gas aperture 44 whereby the flow of the gas through the chamber 42 acts to lower the temperature of the chamber 42. The gas flows out of the chamber 42 through an outlet aperture 46, not shown. The gas is delivered to the aperture 44 through a plurality of gas passages 48 which are disposed throughout the housing 22. Similar gas passages 48 are in flow communication with the outlet aperture 46 for the transport of the gas from the chamber 42. The gas flows into the gas passages 48 through a gas inlet 50, located on the top of the housing 22. The gas flows out from the housing 22 at gas exhaust passage 52, also located on the top of the housing 22. For most applications, the gas is sea level atmospheric air. The cooling system 32 of this embodiment is cooled by approximately 0.5 gallons per minute of water and approximately 1 cubic foot per minute of air.

This embodiment has a photodiode system 58 for each of the ultraviolet lamps 24. Each photodiode system 58 responds to the output of each of the ultraviolet lamps 24 by generating a voltage that is proportional to the light that it receives from the ultraviolet lamps 24. This voltage is transmitted to a comparitor circuit located in a power supply cabinet. When the voltage attains a predetermined minimum level, an alarm light is activated to notify the operator. There is also a thermistor 57, not shown, located in the gas exhaust passage 52. A thermistor is a device that changes its resistance value proportional to an ambient temperature. There is a circuit in the power supply cabinet that monitors this resistance and will activate an alarm at a predetermined high temperature and will deactivate the ultraviolet lamps 24 at a second higher predetermined temperature. In this embodiment, the thermistor 57 generates a warning signal at 65° C. and deactivates the ultraviolet lamps 24 at a temperature of 88° C.

There is illustrated in FIG. 4 a bottom view of the sterilization apparatus of the present invention. As shown in FIG. 4, the transparent plates 30 form the lower boundary of the enclosed pressurized chamber 42 which encompass the ultraviolet lamps 24. The transparent plates 30 enhance the transmission of ultraviolet light having a wavelength of 254 nanometers. However, light of other wavelengths are also transmitted through the transparent plates 30. The shutter assembly 28 may be positioned in either a closed or open position. The closed position has the shutter assembly 28 blocking the radiation emanating from the ultraviolet lamps 24. In the closed position, the shutter assembly 28 expedites the temperature increase for the ultraviolet lamps 24 by allowing for the retention of heat inside of the enclosed pressurized chamber 42. In this manner, the ultraviolet lamps 24, and thus the sterilization apparatus 20, may more quickly warm to the operating temperature. In a conventional installation, the ultraviolet lamp 24 normally operates in a temperature range of 593° to 815° C. Once the operating temperature has been reached, the shutter assembly 28 is placed in the open position. As shown in FIG. 4, the shutter assembly 28 is in the open position allowing for the irradiation and sterilization of cartons being advanced below the sterilization apparatus 20. The reflectors 26 form the upper boundary of the enclosed pressurized chamber 42 and reflect ultraviolet light/radiation upon the cartons being advanced below the sterilization apparatus 20.

Also, the shutter assembly 28 is equipped with a dual sensing switch in conjunction with a safety relay that indicates that the shutter assembly 28 is in its closed position. The sensor will deactivate the ultraviolet lamps 24 if the sensor does not sense the shutter assembly 28 in a closed position when the doors to the filling machine are open. This will prevent any harm to the operator. The shutter assembly 28 is also equipped with a sensor that transmits a signal to the filling machine indicating that the shutter assembly 28 is in the open position therefore rendering the machine ready for filling of the cartons.

There is illustrated in FIG. 5 a rearward view of the present invention integrated above a conveyance system for advancing cartons to the sterilization apparatus. As shown in FIG. 5, the sterilization apparatus 20 is positioned above a conveyor system generally designated 60. The conveyor system 60 carries cartons 62 from station to station along a form, fill and seal machine. The sterilization apparatus 20 of the present invention is designed to utilize minimal space on the form, fill and seal machine. The placement of the plurality of ultraviolet lamps 24 transverse to the advancement of the cartons along the conveyor system 60 decreases the amount of space necessary for the effective sterilization of the cartons. The minimization of space provided by the sterilization apparatus 20 of the present invention allows for the integration of a spout applicator, not shown, on the form, fill and seal machine without substantial adjustment to the machine. The shutter assembly 28 is shown in the open position allowing for sterilization of cartons through ultraviolet light. The shutter assembly 28 moves transverse to the advancement of the cartons 62 along the conveyor system 60 thereby minimizing space. The cartons 62 have an open end exposing the interior sidewalls and bottom wherein the desired contents will be in contact with the cartons 62. There is also shown in FIG. 5 the fluid quick connections between the sterilization apparatus 20 and an outside source and disposal. The connections also allow for the sterilization apparatus 20 to be removed for cleaning and inspection without the use of tools.

The sterilization apparatus 20 is also equipped with a dual sensing switch in conjunction with a safety relay which monitors if the apparatus 20 is in its proper operating position. If the apparatus is not in its proper position, the ultraviolet lamps 24 deactivate thereby preventing any harm to individuals near the apparatus 20.

There is illustrated in FIG. 6 a side cut-away view of the sterilization apparatus of the present invention. As shown in FIG. 6, the enclosed pressurized chamber 42 encompasses the ultraviolet lamp 24 and has a boundary of the reflector 26 and the transparent plate 30. As mentioned previously, the chamber 42 is maintained at a pressure of approximately 1.1 atmospheres for the embodiment of FIG. 1 through the flow of a small amount of gas.

There is illustrated in FIG. 7 one embodiment of the reflectors of the present invention. As shown, in FIG. 7, the reflectors 26 have parabolic shapes which are defined by the formula $y=x^2/4a$. The reflectors 26 are exactly two parabolic curves which have common focus at the center of the arc. The parabolic shape of each of the reflectors 26 is a compound of an imperial quart carton rotated through 13 degrees from the vertical so that the angle between the axes is 26 degrees. The cooling manifold 34 which surrounds the upper surface of each of the reflectors 26 has a plurality of fluid passageways 36 therethrough for the circulation of a fluid for cooling the reflectors 26.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. An apparatus for sterilizing cartons which are being advanced along a conveyor system, the apparatus comprising:

a plurality of sources of ultraviolet light, each of the plurality of sources of ultraviolet light being elongated and having a longitudinal axis, the longitudinal axis of each of the plurality of sources of ultraviolet light being substantially transverse to the advancement of the cartons along the conveyor system;

a plurality of reflectors, each of the plurality of reflectors extending along the longitudinal axis of each of the corresponding plurality of ultraviolet light sources, each of the plurality of reflectors disposed a distance from each of the corresponding plurality of ultraviolet light sources which substantially reflects an incident ultraviolet radiation toward the interior of the cartons;

a cooling system generally disposed above the plurality of reflectors and in thermal communication with each of the plurality of reflectors;

a plurality of transparent plates, each of the plurality of transparent plates corresponding to each of the plurality of ultraviolet light sources and forming an enclosed pressurized environment greater than one atmosphere pressure about each of the plurality of ultraviolet light sources;

a gas inlet disposed within the pressurized environment and in flow communication with a gas source, the gas inlet controlling the flow of a gas to pressurize the enclosed pressurized environment and to cool the ultraviolet light sources; and a shutter assembly for selectively blocking the ultraviolet radiation emitted from the plurality of ultraviolet light sources.

2. The apparatus according to claim 1 further comprising a plurality of pressure switches to detect and indicate a decrease in pressure in the enclosed pressurized environment.

3. The apparatus according to claim 1 further comprising a plurality of temperature switches for indicating an elevated temperature at a corresponding plurality of ultraviolet light sources, each of the plurality of temperature switches having means for deactivating each corresponding plurality of ultraviolet light sources when an elevated temperature is detected.

4. The apparatus according to claim 1 wherein the cooling system comprises a cooling manifold substantially encompassing and in thermal communication with the upper surface of each of the plurality of reflectors, the cooling manifold having a plurality of passageways for the flow of a circulating fluid.

5. The apparatus according to claim 4 wherein the circulating fluid is water.

6. The apparatus according to claim 1 wherein each of the plurality of reflectors is transversely curved about the longitudinal axis, and each of the plurality of reflectors has opposite parabolic sides connected to each other along an apex parallel to the longitudinal axis.

7. The apparatus according to claim 1 wherein the transparent plate substantially enhances the transmission of light having a wavelength of 254 nanometers.

8. The apparatus according to claim 1 wherein the enclosed pressurized environment is pressurized at least 1.1 atmosphere of pressure.

9. The apparatus according to claim 1 wherein the cooling system comprises a plurality of cooling manifolds for cooling each of the plurality of reflectors, each of the cooling manifolds juxtaposed to each of the plurality of reflectors and in thermal communication with each of the plurality of reflectors, each of the cooling manifolds having a plurality of internal passageways for flowing therethrough a cooling fluid in order to extract heat from the plurality of reflectors.

10. The apparatus according to claim 9 wherein the cooling fluid is water.

11. A method for sterilizing cartons which are being advanced along a conveyor system, the method comprising the steps of:

positioning each of the cartons within a sterilization apparatus located on the conveyor system, the sterilization apparatus comprising a plurality of sources of ultraviolet light, each of the plurality of sources of ultraviolet light being elongated and having a longitudinal axis, the longitudinal axis of each of the plurality of sources of ultraviolet light being substantially transverse to the advancement of the cartons along the conveyor system, a plurality of reflectors, each of the plurality of reflectors extending along the longitudinal axis of each of the corresponding plurality of ultraviolet light sources, each of the plurality of reflectors disposed a distance from each of the corresponding plurality of ultraviolet light sources which substantially reflects an incident ultraviolet radiation toward the interior of the cartons, a cooling system generally disposed above the plurality of reflectors and in thermal communication with each of the plurality of reflectors, a plurality of transparent plates, each of the plurality of transparent plates corresponding to each of the plurality of ultraviolet light sources and forming an enclosed pressurized environment greater than one atmosphere pressure about each of the plurality of ultraviolet light sources, a gas inlet disposed within the pressurized environment and in flow communication with a gas source, the gas inlet controlling the flow of a gas to pressurize the enclosed pressurized environment and to cool the ultraviolet light sources, and a shutter assembly for selectively blocking the ultraviolet radiation emitted from the plurality of ultraviolet light sources;

subjecting each of the cartons to a predetermined amount of ultraviolet radiation for a predetermined time sufficient to sterilize each of the cartons, the ultraviolet radiation originating from the sterilization apparatus;

substantially, simultaneously maintaining a temperature for the sterilization apparatus while optimizing the amount of ultraviolet radiation originating from the sterilization apparatus; and removing each of the cartons from within the sterilization apparatus.

12. The method according to claim 11 wherein the subjecting the cartons to an amount of ultraviolet radiation is accomplished through direct radiation from the plurality of ultraviolet light sources and incident radiation from the plurality of reflectors.

* * * * *